US008915190B2

(12) United States Patent
Kravel

(10) Patent No.: US 8,915,190 B2
(45) Date of Patent: Dec. 23, 2014

(54) LAUNCHED SMOKE GRENADE

(75) Inventor: Jacob Kravel, Great Neck, NY (US)

(73) Assignee: CSI-Penn Arms, LLC, Jamestown, PA (US)

( * ) Notice: Subject to any disclaimer, the term of this patent is extended or adjusted under 35 U.S.C. 154(b) by 143 days.

(21) Appl. No.: 13/546,414

(22) Filed: Jul. 11, 2012

(65) Prior Publication Data

US 2014/0013985 A1 Jan. 16, 2014

(51) Int. Cl.
*F42B 30/06* (2006.01)
*F42B 30/00* (2006.01)

(52) U.S. Cl.
CPC ..... *F42B 30/006* (2013.01)
USPC ..... 102/485; 102/334

(58) Field of Classification Search
CPC ..... F42B 30/06; F42B 30/04; F42B 12/48; F42B 8/18
USPC ..... 102/482, 483, 484, 485; 42/105
See application file for complete search history.

(56) References Cited

U.S. PATENT DOCUMENTS 3,620,162 A * 11/1971 King ..... 102/485
3,690,026 A * 9/1972 Rose ..... 42/77
5,574,245 A * 11/1996 Buc et al. ..... 102/485

* cited by examiner

*Primary Examiner* — Bret Hayes
*Assistant Examiner* — Joshua Freeman
(74) *Attorney, Agent, or Firm* — Bennet K. Langlotz; Langlotz Patent & Trademark Works, Inc.

(57) ABSTRACT

A launched smoke grenade has a body having a hollow interior that contains an active grenade material and a bullet trap element formed of an inert material, the body defining a muzzle receptacle bore that is adapted to receive a rifle muzzle, the active grenade material defining a cavity, and the bullet trap element having at least a forward portion received in the cavity. The active grenade material may include a smoke generation component and an ignition component. There may be a bullet suppressing material positioned between the rifle muzzle and the inert material. The bullet suppressing material and the inert material may be made of different materials.

20 Claims, 3 Drawing Sheets

LAUNCHED SMOKE GRENADE

FIELD OF THE INVENTION

The present invention relates to grenades, and more particularly to a smoke grenade that is propelled from a launcher.

BACKGROUND OF THE INVENTION

A rifle grenade is a grenade that uses a rifle-based launcher to permit a longer effective range than would be possible if the grenade was thrown by hand. The practice of projecting grenades with rifle-mounted launchers was first widely used during World War I and continues to the present, with the term "rifle grenade" now encompassing many different types of payloads including high explosive, fragmentation, and anti-tank warheads as well as concussion, smoke, incendiary, and flare missiles.

A wide variety of rifle grenades have been developed over the past 100 years. The rod-type rifle-grenade is a standard hand-grenade with a metallic rod attached to the base so it can be fired from a standard rifle. They were developed prior to World War I. The following steps are followed when using a rod-type rifle grenade:

1. Insert the rod-type rifle-grenade down the barrel of a standard rifle.
2. Insert a special blank cartridge (with a launch charge but no bullet) into the rifle's chamber.
3. Place the rifle's butt-stock on the ground.
4. While holding the grenade's safety-spoon with one hand, remove the safety pin with the other.
5. Place free hand on the rifle's grip and prepare to fire.
6. Release the grenade's safety-spoon, quickly place said hand on the rifle's forestock, and immediately fire the rifle.

This design has a number of disadvantages. If the soldier does not immediately launch the grenade, the grenade will time-out and explode, resulting in serious injury or death. Repeated launching of rod-grenades also places an extreme amount of stress on the rifle barrel and the rifle itself, which quickly makes the rifle useless as an accurate firearm. As a result, the rod-type rifle-grenade fell from favor.

The cup-type launcher replaced the rod-type rifle-grenade during World War I. A soup can-shaped launcher is attached to a rifle's muzzle. The cup-type launcher can launch a standard hand-grenade or a purpose built cup-type grenade. The following steps are followed when using a cup-type grenade:

1. Insert a grenade into the cup launcher. When using a standard hand-grenade remove the safety pin; the cup holds the safety-spoon in place until the grenade launched.
2. Insert a special blank cartridge into the rifle's chamber.
3. Place the butt-stock of the rifle on the ground and fire from this position.

The cup-type launcher has the advantage of using standard hand-grenades. However, the need to load a blank cartridge into the rifle's chamber in order to launch the grenade proved to be clumsy in combat, or blanks may not be available when the need arises. Moreover, when a blank is loaded, the rifle is rendered essentially non-functional for conventional use when the need may arise.

This difficulty lead to the development the French "Vivien and Bessières" shoot-through grenade (or VB grenade). As the name implies these grenades permit the use of live ammunition to launch the grenade. The VB grenade has a hole through the middle that permits the passage of a standard bullet through the grenade. The bullet arms the grenade, the expanding gases launch the grenade, and the grenade explodes 8 seconds later. These characteristics eliminate the need for a special blank round to launch the grenade. The following steps are followed when using a VB grenade:

1. Insert VB grenade into the cup-type launcher.
2. Place the butt-stock of the rifle on the ground and fire from this position.

The 22 mm type rifle grenade launcher was developed prior to World War II. This type of launcher is attached to a rifle's muzzle and allows for the use of a wide range of rifle-grenades, from powerful anti-tank rounds to simple finned tubes with a fragmentation hand-grenade attached to the end. These rifle-grenades come in "standard" type, which are propelled by a blank cartridge inserted into the chamber of the rifle, or "bullet trap" and "shoot through" types, which allow the use of live ammunition. All modern 22 mm rifle-grenades explode on impact. All standard issue NATO rifles are capable of launching STANAG type 22 mm rifle grenades from their integral flash hiders without the use of an adapter. However, a blank cartridge is required. Modern bullet-trap rifle-grenades such as the French APAV40 can be fired as fast as a soldier can place a grenade on an FAMAS rifle's muzzle and pull the trigger. The APAV40 has a bullet trap consisting of a piece of copper placed at the bottom of the tube. Its rear part has a recess for absorbing the conventional ball ammunition and a shock absorber with radial vents and a central vent on its front. The APAV40 has to impact the target in order to ignite. The following steps are followed when using a bullet trap grenade:

1. Place 22 mm rifle-grenade over the spigot attachment or the rifle's flash hider.
2. Aim at target and fire rifle.

By the late 1970s, rifle grenades and the use of rifles as launchers began to be replaced by dedicated grenade launchers. First seen in the United States armed forces, these grenade launchers generally took the form of a separate weapon, such as the M79 grenade launcher. Alternatively, under-barrel attachments to assault rifles were employed, such as the M203 grenade launcher attached to an M-16 rifle.

Modern combined arms doctrine dictates that every infantry unit should have a certain percentage of dedicated grenadiers, or soldiers equipped with a grenade launcher or combination rifle/grenade launcher. The criticism of this doctrine is that if the grenadiers in a group are disabled or separated from the group, then the group has completely lost the grenade launcher as a heavy fire support. With the addition of rifle grenades launched by standard rifles using standard ammunition, each soldier can be equipped with a small number of rifle grenades, so every individual soldier has some form of heavy firepower.

Therefore, a need exists for a new and improved launched smoke grenade that uses a standard unmodified M-16 rifle and live ammunition as a launcher. In this regard, the various embodiments of the present invention substantially fulfill at least some of these needs. In this respect, the launched smoke grenade according to the present invention substantially departs from the conventional concepts and designs of the prior art, and in doing so provides an apparatus primarily developed for the purpose of providing a smoke grenade that is launched from a standard unmodified M-16 rifle using live ammunition.

SUMMARY OF THE INVENTION

The present invention provides an improved launched smoke grenade, and overcomes the above-mentioned disadvantages and drawbacks of the prior art. As such, the general purpose of the present invention, which will be described subsequently in greater detail, is to provide an improved launched smoke grenade that has all the advantages of the prior art mentioned above.

To attain this, the preferred embodiment of the present invention essentially comprises a body having a hollow interior that contains an active grenade material and a bullet trap element formed of an inert material, the body defining a muzzle receptacle bore that is adapted to receive a rifle muzzle, the active grenade material defining a cavity, and the bullet trap element having at least a forward portion received in the cavity. The active grenade material may include a smoke generation component and an ignition component. There may be a bullet suppressing material positioned between the rifle muzzle and the inert material. The bullet suppressing material and the inert material may be made of different materials. There are, of course, additional features of the invention that will be described hereinafter and which will form the subject matter of the claims attached.

There has thus been outlined, rather broadly, the more important features of the invention in order that the detailed description thereof that follows may be better understood and in order that the present contribution to the art may be better appreciated.

BRIEF DESCRIPTION OF THE DRAWINGS

The same reference numerals refer to the same parts throughout the various figures.

DESCRIPTION OF THE CURRENT EMBODIMENT

Figure 1:
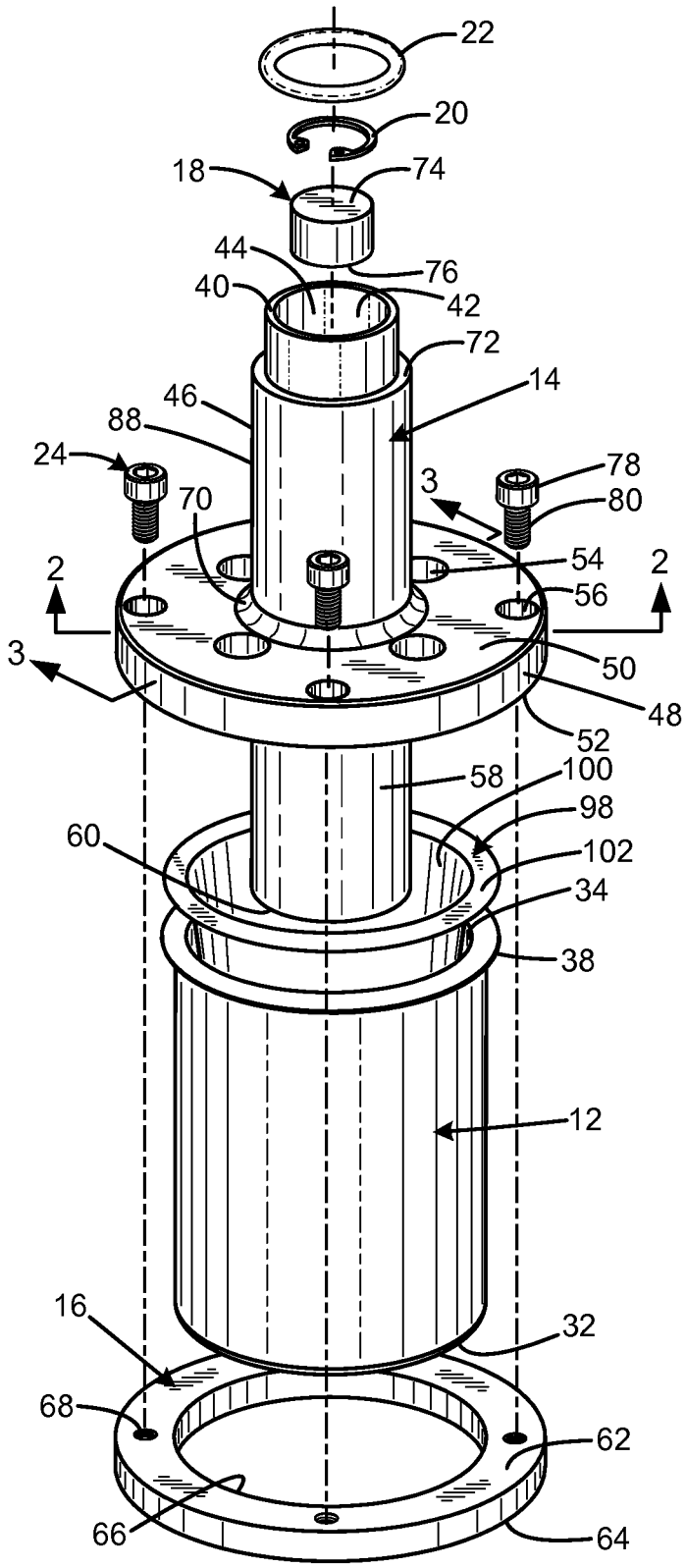
FIG. 1 is an exploded view of the current embodiment of an unfilled launched smoke grenade constructed in accordance with the principles of the present invention.

An embodiment of the launched smoke grenade of the present invention is shown and generally designated by the reference numeral 10.

FIG. 1 illustrates the improved launched smoke grenade 10 of the present invention in an unfilled state. More particularly, the launched smoke grenade has a cylindrical canister 12, a launching adapter 14, a locking ring 16, a bullet suppressor 18, an internal snap ring 20, an O-ring 22, and four socket head cap screws 24 (only three of which are visible). In the current embodiment, the smoke grenade 10 is adapted to fit onto the flash hider of an M-16 rifle. This enables the smoke grenade to be used with even rifles with very short barrels that are designed to maneuvering close quarters such as the interior of the building because the smoke grenade does not engage the barrel and is compact. However, the proportions of the smoke grenade can be altered to fit a firearm of any desired size.

Figure 2:
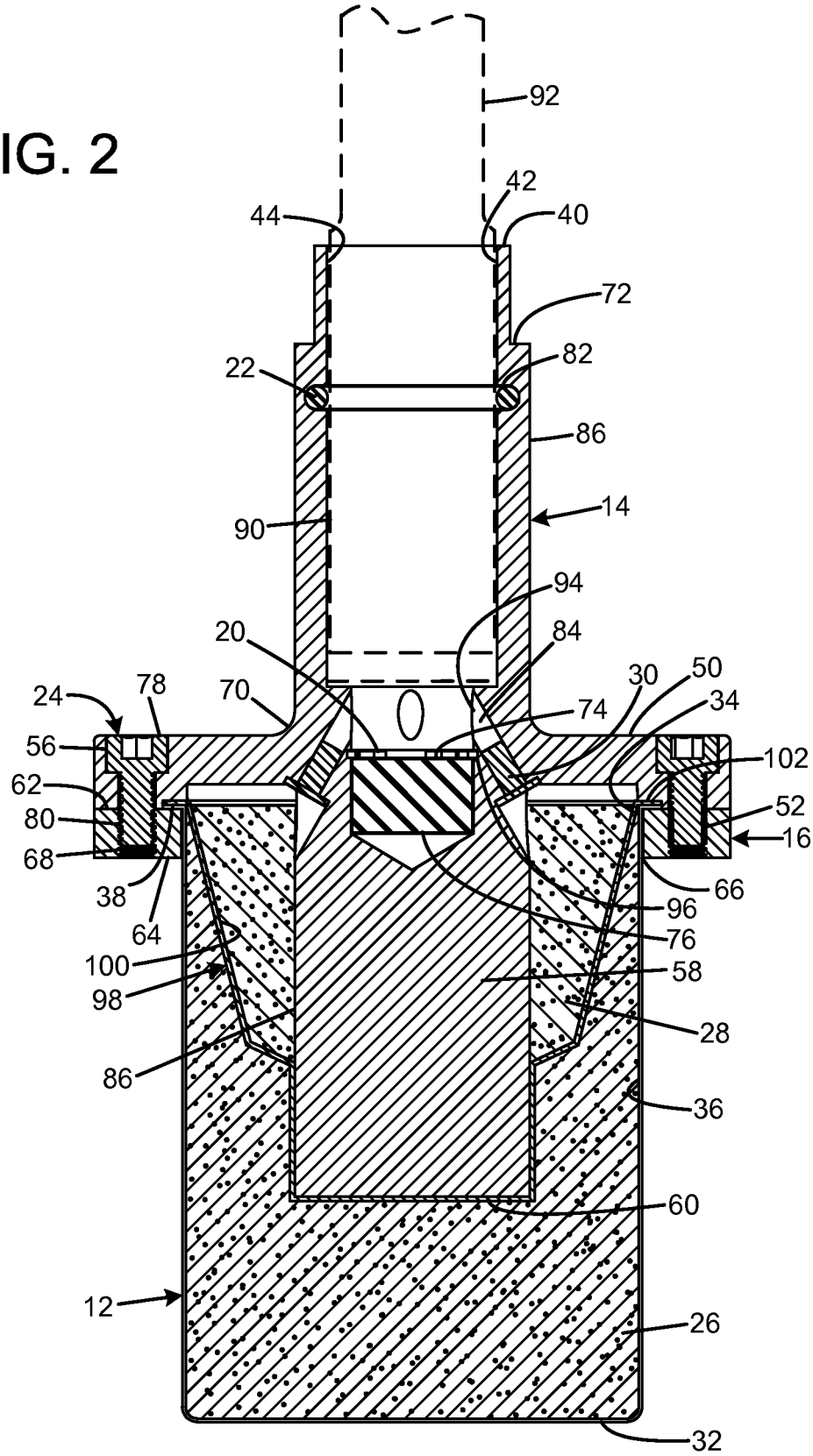
FIG. 2 is a side sectional view of the current embodiment of a filled launched smoke grenade constructed in accordance with the principles of the present invention.

The canister 12 has a closed bottom 32, an open top 34 that forms an outwardly protruding flange 38, and a hollow interior 36 (shown in FIG. 2). A divider 98 is received within the interior of the canister. The divider has an outwardly protruding flange 102 and a concave hollow interior 100.

The aluminum launching adapter 14 has a central flange 48 with a top 50 and a bottom 52. A hollow cylinder 88 protrudes upward from the top, and a solid aluminum bar cylinder 58 protrudes downward from the bottom. The flange defines four screw holes 56 adjacent to the outer perimeter and four smoke holes 54 adjacent to the hollow cylinder. A shoulder 70 provides a radiused transition from the top 50 to the hollow cylinder.

The hollow cylinder 88 has an exterior 46 that defines a shoulder 72 that transitions to a narrower diameter portion between the top 40 of the hollow cylinder and the shoulder 72. A central muzzle receptacle bore 42 defines a hollow interior 44 within the hollow cylinder.

The interior 44 of the hollow cylinder 88 receives the rubber bullet suppressor 18, stainless steel internal snap ring 20, and O-ring 22.

The top 62 of the locking ring 16 is attached to the bottom 52 of the flange 48 by four steel socket head cap screws 24. A central bore 66 in the locking ring permits the locking ring to receive the canister 12. Four threaded bores 68 are present in the top of the locking ring and are actually registered with the screw holes 56 in the flange 48 of the launching adapter 14.

Figure 3:
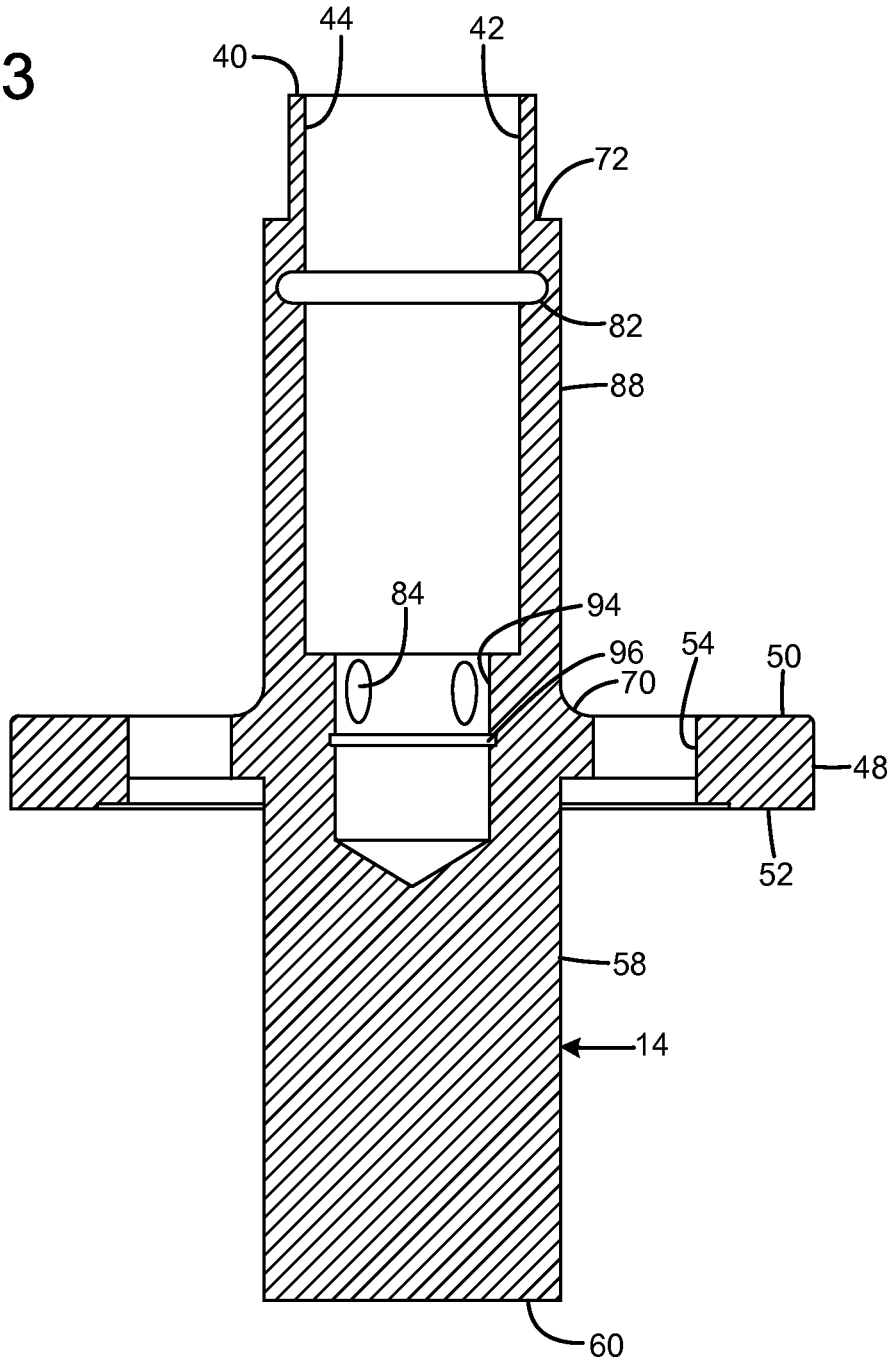
FIG. 3 is a side sectional view of the current embodiment of the launching adapter of the present invention.

FIG. 2 illustrates the improved launched smoke grenade 10 of the present invention in a filled state mounted on a flash hider 90 attached to a rifle barrel 92 of an M-16 rifle. FIG. 3 illustrates additional details of the launching adapter 14. More particularly, the launched smoke grenade is assembled such that the flange 38 on the top 34 of the canister 12 is captured between the top 62 of the locking ring 16 and the bottom 52 of the flange 48 of the launching adapter 14. The threaded portions 80 of the cap screws 24 pass through the screw holes 56 in the flange 48 and are threadedly received by the threaded bores 68 in the top of the locking ring.

The interior 36 of the canister 12 receives a consolidated smoke pellet 26 that is separated from a hardened exterior coating of starter slurry 28 by the steel divider 98. It is critical that the starter slurry be separated from the consolidated smoke pellet prior to use of the smoke grenade 10 because otherwise the two compositions will react and cause the smoke grenade to malfunction. The starter slurry burns at a sufficiently high temperature to melt the steel divider and ignite the consolidated smoke pellet.

The smoke pellet has a cylindrical recess 86 that is sized and shaped to fit around the solid cylinder 58 of the launching adapter 14 while providing adequate space for the solid cylinder to expand and deform. This essential overlap or nesting feature of the smoke pellet and solid cylinder reduces the overall length of the grenade while still providing adequate active smoke generating material with an adequate length of bullet trap element. The recess and the unfilled upper portion of the interior of the canister also provide an expansion chamber for gases to accumulate prior to being emitted from the canister in a controlled manner.

The smoke holes 54 in the flange 48 of the launching adapter 14 communicate with the interior of the canister 12. Smoke emits from the open top 34 of the canister through the smoke holes. In addition, the hollow cylinder 88 of the launching adapter has four angled vents 84 that communicate between the interior 44 of the hollow cylinder and the interior of the canister. Prior to launch, the angled vents are plugged by Duco® cement plugs 30, and the smoke holes are plugged by tabs to protect the starter slurry 28 and smoke pellet 26 from the environment. The inlets for the vents 84 are positioned above the bullet suppressor 18 and the internal snap ring 20 at a constriction 94 so the launch gases can enter the vents without obstruction by the snap ring and bullet suppressor. A groove 96 in the interior of the hollow cylinder receives the internal snap ring. The internal snap ring retains the bullet suppressor within the constriction 94. A groove 82 in the interior of the hollow cylinder is located below the shoulder 72 and receives the O-ring 22. The O-ring prevents the smoke grenade 10 from falling off the flash hider 90 when the rifle is in a muzzle down condition, but does not prevent launching of the smoke grenade when the rifle is fired.

To launch the smoke grenade 10, the flash hider 90 on the muzzle end of an M-16 rifle barrel 92 is inserted into the central bore 42 in the hollow cylinder 88 until it is stopped by the constriction 94. Upon impact by the firing pin of the rifle, the primer of a standard 5.56×45 mm NATO cartridge generates a flash that ignites the propellant within the cartridge. The resulting flame and gases from the cartridge exit the rifle barrel through the flash hider, enter the angled vents 84, ignite and burn through the plugs 30, ignite the starter slurry 28, and burn through the tabs in the smoke holes 54. Unlike conventional bullet trap grenades that ignite upon impact with a target, the smoke grenade 10 captures the flame and gases from the cartridge in order to start ignition.

The bullet also exits the rifle barrel 92 through the flash hider 90, and subsequently impacts the top 74 of the bullet suppressor 18. The bullet drives the bullet suppressor upward into the solid cylinder 58. The rubber bullet suppressor permits the metal jacket of the bullet to pass through and captures any backward ricochet of the jacket off of the solid cylinder to prevent bullet fragments from escaping rearwardly from the smoke grenade 10. The solid cylinder deforms and traps the bullet suppressor and bullet. The gases generated by the ignited propellant and the impact of the bullet on the bullet suppressor and solid cylinder serve to push the smoke grenade upward off of the rifle barrel. The gases also exit the smoke holes 54, creating a propulsion effect. While the smoke grenade is in flight, the starter slurry, which has a lower ignition temperature than the smoke pellet 28, ignites the smoke pellet. The resulting thick black smoke exits the smoke grenade via the smoke holes.

While a current embodiment of a launched smoke grenade has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A launched grenade comprising:

a body having a hollow interior;

the body interior containing an active grenade material that includes a smoke generation component and an ignition component; wherein the ignition component is ignited from gases and heat emitted from a fired rifle cartridge and the smoke generation component is proximate the ignition component such that combustion of the ignition component ignites the smoke generation component;

the body interior containing a bullet trap element formed of an inert material;

the body defining a muzzle receptacle bore that is adapted to receive a rifle muzzle;

the active grenade material defining a cavity and the bullet trap element having at least a forward portion received in the cavity.

2. The grenade of claim 1 wherein the smoke generation component and the ignition component are separated by a barrier prior to ignition of the ignition component and come into contact following ignition of the ignition component.

3. The grenade of claim 1 further comprising a bullet suppressing material positioned between the rifle muzzle and the inert material.

4. The grenade of claim 3 wherein the bullet suppressing material and the inert material are made of different materials.

5. The grenade of claim 3 wherein the bullet suppressing material is made of rubber.

6. The grenade of claim 3 wherein the inert material is made of aluminum.

7. The grenade of claim 1 wherein the body has at least one passage that communicates from the muzzle receptacle bore to the smoke generation component within the hollow interior of the body.

8. The grenade of claim 7 wherein the body has a plurality of passages that communicate from the muzzle receptacle bore to the smoke generation component within the hollow interior of the body.

9. The grenade of claim 7 further comprising an environmental closure element within the at least one passage that communicates from the muzzle receptacle bore to the active grenade material within the hollow interior of the body prior to ignition of the propellant.

10. The grenade of claim 1 wherein the body has at least one passage that communicates from the smoke generation component within the hollow interior of the body to the external environment.

11. The grenade of claim 1 wherein the body has a plurality of passages that communicate from the smoke generation component within the hollow interior of the body to the external environment.

12. The grenade of claim 1 further comprising the active grenade material, inert material, and hollow interior of the body defining an expansion chamber that receives gases generated by the smoke generation component and emits the gases generated by the smoke generation component from the cartridge case in a controlled manner.

13. The grenade of claim 1 wherein the muzzle receptacle bore receives the muzzle of an M-16 rifle.

14. The grenade of claim 1 wherein the muzzle receptacle bore defines a groove that receives an O-ring such that the O-ring encircles a portion of a rife received within the muzzle receptacle bore.

15. The grenade of claim 1 wherein the active grenade material encloses at least a portion of the inert material.

16. The grenade of claim 1 wherein the smoke generation component is ignited by the ignition component while the grenade is in flight prior to approaching a target.

17. A launched grenade comprising:

A body having a hollow interior;

the body interior containing an active grenade material that includes a smoke generation component and an ignition component; wherein the ignition component is ignited from gases and heat emitted from a fired rifle cartridge and the smoke generation component is proximate the ignition component such that combustion of the ignition component ignites the smoke generation component;

the body interior containing a bullet trap element formed of an inert material;

the body defining a muzzle receptacle bore that is adapted to receive a rifle muzzle;

the bullet trap element having a forward portion extending forward of the rearmost portion of the active grenade material.

18. The grenade of claim 17 further comprising a bullet suppressing material positioned between the rifle muzzle and the inert material.

19. The grenade of claim 17 wherein the smoke generation component is ignited by the ignition component while the grenade is in flight prior to approaching a target.

20. The grenade of claim 17 further comprising the active grenade material, inert material, and hollow interior of the body defining an expansion chamber that receives gases generated by the smoke generation component and emits the gases generated by the smoke generation component from the body in a controlled manner.

* * * * *